US009319814B2

(12) United States Patent
Zurbruegg et al.

(10) Patent No.: US 9,319,814 B2
(45) Date of Patent: Apr. 19, 2016

(54) METHOD FOR FITTING A HEARING AID DEVICE WITH ACTIVE OCCLUSION CONTROL TO A USER

(71) Applicant: Phonak AG, Staefa (CH)

(72) Inventors: Thomas Zurbruegg, Zürich (CH); Alfred Stirnemann, Zollikon (CH); Stefan Launer, Zürich (CH)

(73) Assignee: Sonova AG, Staefa (CH)

( * ) Notice: Subject to any disclaimer, the term of this patent is extended or adjusted under 35 U.S.C. 154(b) by 297 days.

(21) Appl. No.: 13/794,026

(22) Filed: Mar. 11, 2013

(65) Prior Publication Data

US 2013/0243209 A1 Sep. 19, 2013

(30) Foreign Application Priority Data

Mar. 15, 2012 (EP) ..... 12159767

(51) Int. Cl.
*H04R 25/00* (2006.01)
*H04R 29/00* (2006.01)

(52) U.S. Cl.
CPC ..... *H04R 25/70* (2013.01); *H04R 25/305* (2013.01); *H04R 25/43* (2013.01); *H04R 25/55* (2013.01); *H04R 2225/55* (2013.01); *H04R 2225/61* (2013.01); *H04R 2460/01* (2013.01); *H04R 2460/05* (2013.01); *H04R 2460/11* (2013.01)

(58) Field of Classification Search
CPC ..... H04R 1/1016; H04R 2225/55; H04R 2460/01; H04R 2460/05; H04R 2460/11; H04R 25/30; H04R 25/305; H04R 25/50; H04R 25/70; H04R 3/005
USPC ..... 381/312–321, 60
See application file for complete search history.

(56) References Cited

U.S. PATENT DOCUMENTS

| | | | | |
|---|---|---|---|---|
| 6,035,050 | A | 3/2000 | Weinfurtner et al. | |
| 2009/0238387 | A1 | 9/2009 | Arndt et al. | |
| 2009/0274314 | A1 | 11/2009 | Arndt et al. | |
| 2010/0002896 | A1 * | 1/2010 | Arndt ..... | H04R 25/305 381/318 |

FOREIGN PATENT DOCUMENTS

| | | | |
|---|---|---|---|
| WO | WO 2004021740 | A1 | 3/2004 |
| WO | WO 2006037156 | A1 | 4/2006 |
| WO | WO 2008017326 | A1 | 2/2008 |
| WO | WO 2010083888 | A1 | 7/2010 |
| WO | WO 2012003855 | A1 | 1/2012 |

OTHER PUBLICATIONS

EPO Search Report dated Aug. 30, 2012 for EP App. Ser. No. 12159767.

* cited by examiner

*Primary Examiner* — Sunita Joshi
(74) *Attorney, Agent, or Firm* — Henricks, Slavin & Holmes LLP

(57) ABSTRACT

Methods and apparatus for fitting a hearing aid device (3) that includes a part which is arranged in the ear canal (2) of a user (31).

14 Claims, 3 Drawing Sheets

METHOD FOR FITTING A HEARING AID DEVICE WITH ACTIVE OCCLUSION CONTROL TO A USER

TECHNICAL FIELD

The invention relates to the field of fitting hearing aid devices. More particularly, it relates to a method for fitting a hearing aid device with active occlusion control to a user, said hearing aid device comprising:

An outside microphone for sensing sound of an environment of said user;

A receiver configured for emitting sound into an ear canal of said user;

Means for active occlusion control;

Said means for active occlusion control comprising:

A canal microphone configured for sensing a sound pressure in said ear canal of said user;

An occlusion control compensator filter arranged in a feedback loop and configurable by a compensator filter dataset;

Said method comprising the steps of:

Carrying out a determination of said compensator filter dataset;

Configuring said occlusion control compensator filter with said compensator filter dataset.

BACKGROUND OF THE INVENTION

A hearing aid device is a device for aiding an individual in regard to its hearing. It may be a hearing aid or hearing prosthesis for compensating a hearing loss of its user. It may also be a hearing protection device which helps individuals to hear without damage in noisy environments. Such a device may transmit speech and attenuate noise by selective amplification. The occlusion effect is an effect experienced by individuals when an ear canal is fully or partially closed by an occluding object. In such a condition, the own voice of the individual and other body conducted sounds are perceived by him- or herself unnaturally loud. The earpiece of a hearing aid device can be such an occluding object. Active occlusion control is a method for reducing the occlusion effect actively. Actively means by destructive interference, i.e. emitting a kind of anti-sound. A passive occlusion control (or passive occlusion reduction) would be the provision of a large vent. However, hearing aids with a large vent are prone to feedback and cannot deliver loud low-frequency sound due to leakage from the canal to the outside and cannot provide good sound cleaning due to leakage from the outside into the canal. Providing hearing protective devices with a large vent renders them useless because low-frequency noise can pass without substantial attenuation through the vent. Occlusion is not to be confused with ampclusion. Users of hearing aid devices may perceive their own voice as being unnatural due to its amplification by the hearing aid device. Ampclusion can be counteracted by reducing the hearing aid device amplification in the frequency range of the users voice. Both occlusion control and ampclusion control aim for providing an own voice perceived as more natural.

U.S. Pat. No. 6,035,050 by Weinfurtner discloses a method for determining optimum parameter sets in a hearing aid. During an optimization phase an optimal user specific parameter set is allocated by selecting one of several trial parameter sets available.

WO 2004/021740 A1 by Rasmussen et al. discloses a method for counteracting the occlusion effect of an electronic device like a hearing aid. Sound conditions in the cavity between the ear piece and the tympanic membrane are determined. The transmission characteristics of the transmission path to the receiver counteracts the occlusion effect.

WO 2006/037156 A1 by Mejia et al. discloses an acoustically transparent occlusion reduction method. An electro-acoustic feedback network produces phase cancelling sounds in the ear. The integration with a hearing aid improves the user's perception of own voice.

WO 2008/017326 A1 by Nordahn discloses a method for in-situ occlusion effect measurement. A hearing aid comprises a microphone for external sounds and a microphone for sounds in the occluded ear. An occlusion effect value is produced from the difference. The user may read a text passage or vocalize a sound such as /iii/ or /uuu/. The hearing aid may be fitted based on the occlusion effect value.

US 2009/238387 by Arndt et al. discloses a method for actively reducing occlusion. A transducer transmission function, which is defined for the transmission path from the input of a receiver via the auditory canal to the output of a microphone, is subjected to an automatic plausibility check.

US 2009/274314 by Arndt et al. discloses a method for determining a degree of closure in hearing devices. Arndt mentions active occlusion reduction. An effective vent diameter specifies the degree of closure. An interpretation of this value is easily possible by a hearing device acoustician.

WO 2010/083888 A1 by Rung et al. discloses a method for in situ occlusion effect measurement. An external sound pressure of an occluded ear is measured by the microphone of a BTE hearing aid. The sound pressure at the eardrum is measured by a hearing aid receiver.

WO 2012/003855 A1 by Rung discloses a method for measuring the occlusion effect of a hearing aid user. The diameter of a ventilation channel may be increased to reduce the occlusion effect. Leakage between bands is regarded in the measurement.

SUMMARY OF THE INVENTION

It is an object of the invention to provide a method for fitting active occlusion control means of a hearing aid device in an easy, precise, flexible, robust, sustainable, effective and/or efficient way. This is especially important because active occlusion control does not only reduce occlusion, but also has side effects. A first side effect is a possible instability of the occlusion control loop. A second side effect is the so called waterbed effect according to which there is not only suppression of occlusion sounds but also amplification of sounds at frequencies below and above the suppression. Hence, what is needed is a good trade-off between wanted and unwanted effects suitable for application in practice.

The object can be at least partially achieved by the method of claim 1. Using a complex frequency-dependent plant transfer function and using an objective frequency-dependent occlusion effect function and/or at least one property of it for determining a compensator filter dataset has the advantage that it allows to adapt an active occlusion control means to the needs of a particular individual in an easy, precise and efficient way.

The method of claim 2 can be advantageous in that predefining compensator filter dataset candidates allows to apply audiological expertise prior to the actual fitting, hence a good fitting can be achieved later with less expertise. Candidates can be predefined with regard to the aspects stability and reliability. Selecting between discrete candidates can be easier, more precise, more efficient and less demanding for a fitter and/or a hearing aid device user than adjusting multiple continuous parameters or even curves. There is not even a need for awareness of the multitude of parameters actually applied.

The method of claim 3 can be advantageous in that by scaling the compensator filter the effect of the filter, and thereby the occlusion control strength, can be adjusted in a precise and easy way. It opens up the possibility to provide a user friendly manual adjustability. Good tradeoffs between wanted and unwanted effects may be found. The occlusion control strength may also be maximized up to the bound given by system stability requirements.

The method of claim 4 can be advantageous in that applying selection criteria to a set of compensator filter candidates allows to select a candidate fully automatically or to reduce the number of candidates to be tested by the user and/or the fitter thereby making the choice of an optimum candidate easier and faster.

The method of claim 5 can be advantageous in that actually trying out the hearing aid with different configurations gives a very good indication which fitting is best in the perception of the user. Letting the user actively participate in the fitting improves the acceptance of its results by the user.

The method of claim 6 can be advantageous in that using a complex frequency-dependent vent effect and/or leakage function for determining a compensator filter dataset allows to adapt active occlusion control means to the needs of a particular individual in an especially precise, optimized and efficient way.

The method of claim 7 can be advantageous in that using a fundamental frequency of a voice of the user for determining a compensator filter dataset allows to adapt active occlusion control means to the needs of a particular individual in an especially precise, optimized and efficient way.

The method of claim 9 can be advantageous in that a benefit assessment allows to prevent waste of effort by individuals involved in such a fitting in cases where there is no potential benefit.

The method of claim 10 can be advantageous in that presenting a recorded real life sound stimulus is perceived by the user of the hearing aid as more pleasant than artificially generated stimuli.

Symbols such as "$C_A$", "P", "|OE|" or "$\{C_1, C_2, C_3 \ldots\}$" in the claims are to be regarded as reference signs if they are presented in parentheses and these parentheses are not part of a formula. Reference signs should not be seen as limiting the extent of the matter protected by the claims. Their sole function is to make the claims easier to understand.

Further embodiments and advantages emerge from the claims and the description referring to the figures.

BRIEF DESCRIPTION OF THE DRAWINGS

Below, the invention is described in more detail by referring to the drawings showing exemplified embodiments.

The described embodiments are meant as examples and shall not confine the invention.

DETAILED DESCRIPTION OF THE INVENTION

Figure 1:
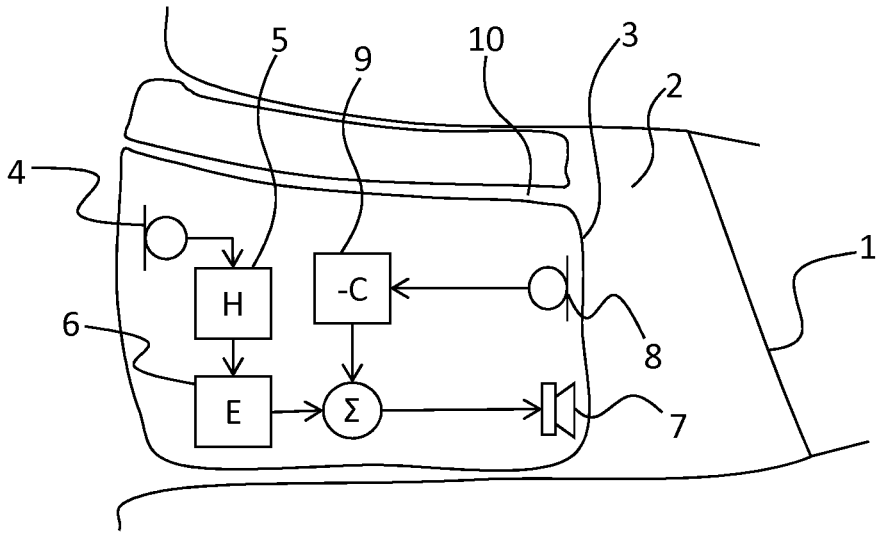
FIG. 1 is a diagram of a hearing aid suited to be fitted by the fitting method of the invention.

FIG. 1 is a hearing aid 3 with active occlusion control suited to be fitted to a user by the fitting method of the invention. It has an outside microphone 4 for sensing sound of an environment of the user. This sound is processed by sound cleaning and loss compensation means 5 configurable by a dataset H. As already indicated, the invention may also be applied for a hearing protection device which would have a similar diagram, just with the difference that there would be no hearing loss compensation. The hearing aid 3 is arranged in an ear canal 2 of the user. Between the hearing aid 3 and the eardrum 1 there is a residual canal space. The receiver 7 is configured for emitting sound into this residual canal space. Residual canal space and the outside are connected by a vent 10. The hearing aid 3 has means for active occlusion control comprising a canal microphone 8 configured for sensing a sound pressure in the residual canal space, an occlusion control compensator filter 9 arranged in a feedback loop and configurable by a compensator filter dataset C and a pre-equalizer 6 configurable by a dataset E arranged in a signal path from the outside microphone 4 to the receiver 7. The dataset E may be determined based on the compensator filter dataset C by the formula E=1+P*C.

The term "canal microphone" in the present document is to be interpreted in a broad manner. It is meant to cover all transducers which are suitable for sensing a sound and/or vibration in the residual canal space, for example conventional microphones, but also optical microphones, acceleration sensors and/or strain gauges. The canal microphone 8 may also be integrated or combined with the receiver 7. Both transducers may simply share a common casing and/or wax protection system and be otherwise separate. However, it is also possible that the two transducers share the same membrane or even a common coil. It is also possible to sense the sound in the residual canal space by one or two vent microphones, the sound inlets of which are arranged in the wall of the vent 10. A directional vent microphone or two vent microphones combined with a special processing may allow to determine which sounds in the vent 10 originate from the residual canal space and not from the outside. The canal microphone 8 may also be combined, complemented and/or enhanced with various further sensors.

Figure 2:
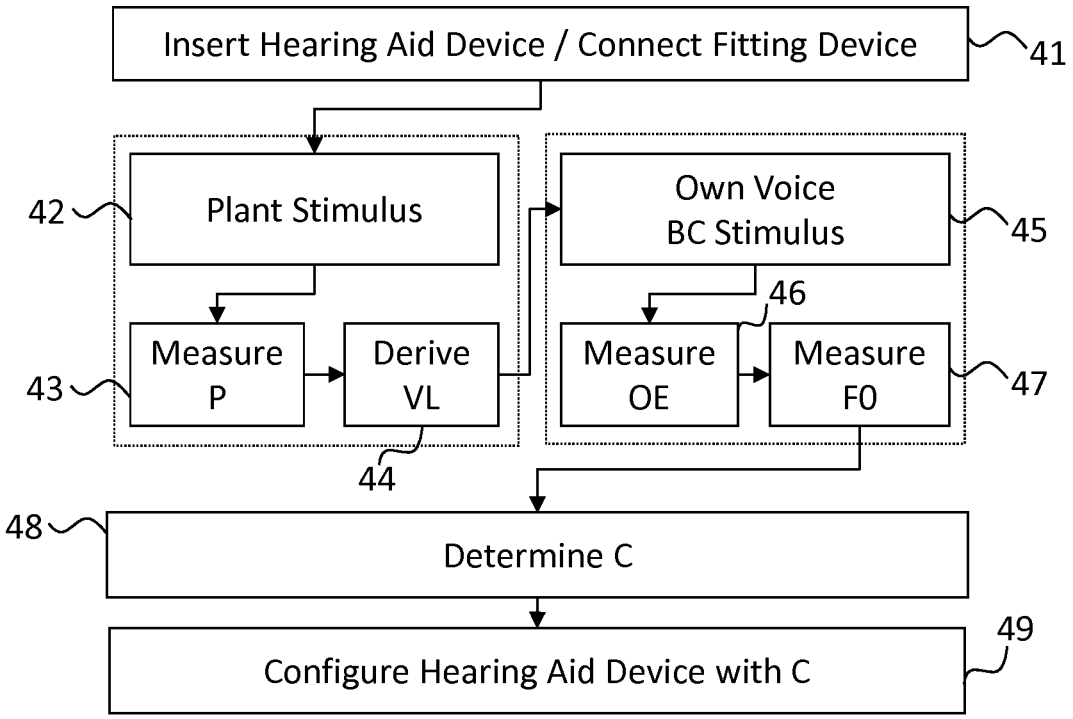
FIG. 2 is a flow diagram illustrating an embodiment of the fitting method of the invention.

FIG. 2 is a flow diagram illustrating an embodiment of the fitting method of the invention. In a first step 41, the hearing aid device is inserted at least partially into the ear canal. A communication connection may be established between the hearing aid device and a fitting device. The hearing aid device may be switched into a fitting mode. In a second step 42, a plant stimulus is generated and presented by the receiver. In a third step 43, a complex frequency-dependent plant transfer function P from an input of the receiver to an output of the canal microphone is measured by sensing a resulting sound in the ear canal and by analyzing the resulting sound in regard to the plant stimulus. In a fourth step 44, a complex frequency-dependent vent effect and/or leakage function VE of an earpiece of the hearing aid device is derived from the frequency complex dependent plant transfer function P. In a fifth step 45, the user's voice is activated and/or a bone conduction stimulus is presented. In a sixth step 46, an objective frequency-dependent occlusion effect function OE is measured by sensing a canal sound in the ear canal, by obtaining a reference sound and by analyzing the canal sound in regard to the reference sound. The reference sound may be the user's voice as an outside sound sensed by an outside microphone and/or the bone conduction stimulus. Strictly speaking, not sounds are analyzed but corresponding signals. In a seventh step 47, a fundamental frequency F0 of the voice of the user is determined from the canal sound and/or the outside sound. In an eighth step 48, a determination of a compensator filter dataset C is carried out by selecting a raw compensator filter dataset $C_{RAW}$ from a set of candidates $\{C_1, C_2, C_3 \ldots\}$ and by scaling it with a scaling factor g. In the selection process the data determined before is used, namely the complex frequency-dependent plant transfer function P, the complex objective frequency-dependent occlusion effect function OE, the frequency-dependent vent effect and/or leakage function VE and/or the fundamental frequency F0. In a ninth step 49 the occlusion control compensator filter may be configured with the compensator filter dataset C. Optionally, if there is a pre-equalizer, it may be configured with a dataset E. The hearing aid device may then be switched from the fitting mode to the operation mode.

The sequence and comprehension of measurements and other steps of this flow diagram is purely exemplary and may be composed and varied in various ways. For example the occlusion effect measurement may be carried out before the plant measurement or may be replaced by an estimation based on already existing data. Further, only a magnitude |OE| or a property of the complex objective frequency-dependent occlusion effect function OE may be determined and/or regarded. The frequency-dependent vent effect and/or leakage function VE may be left out completely or only a magnitude |VE| of it or a cutoff frequency $f_{VE}$ of it may be determined and/or regarded. The fundamental frequency F0 may also be left out completely, or instead a fundamental frequency range $\{F0_{min}, F0_{max}\}$ may be determined and regarded.

The method steps are presented in the claims in particular sequences. These sequences are exemplary and not mandatory, i.e. the claims are to be interpreted such that they cover also carrying out the same steps, but in other sequences, as far as it is feasible. In particular step B and C of claim 1 may be interchanged.

Figure 3:
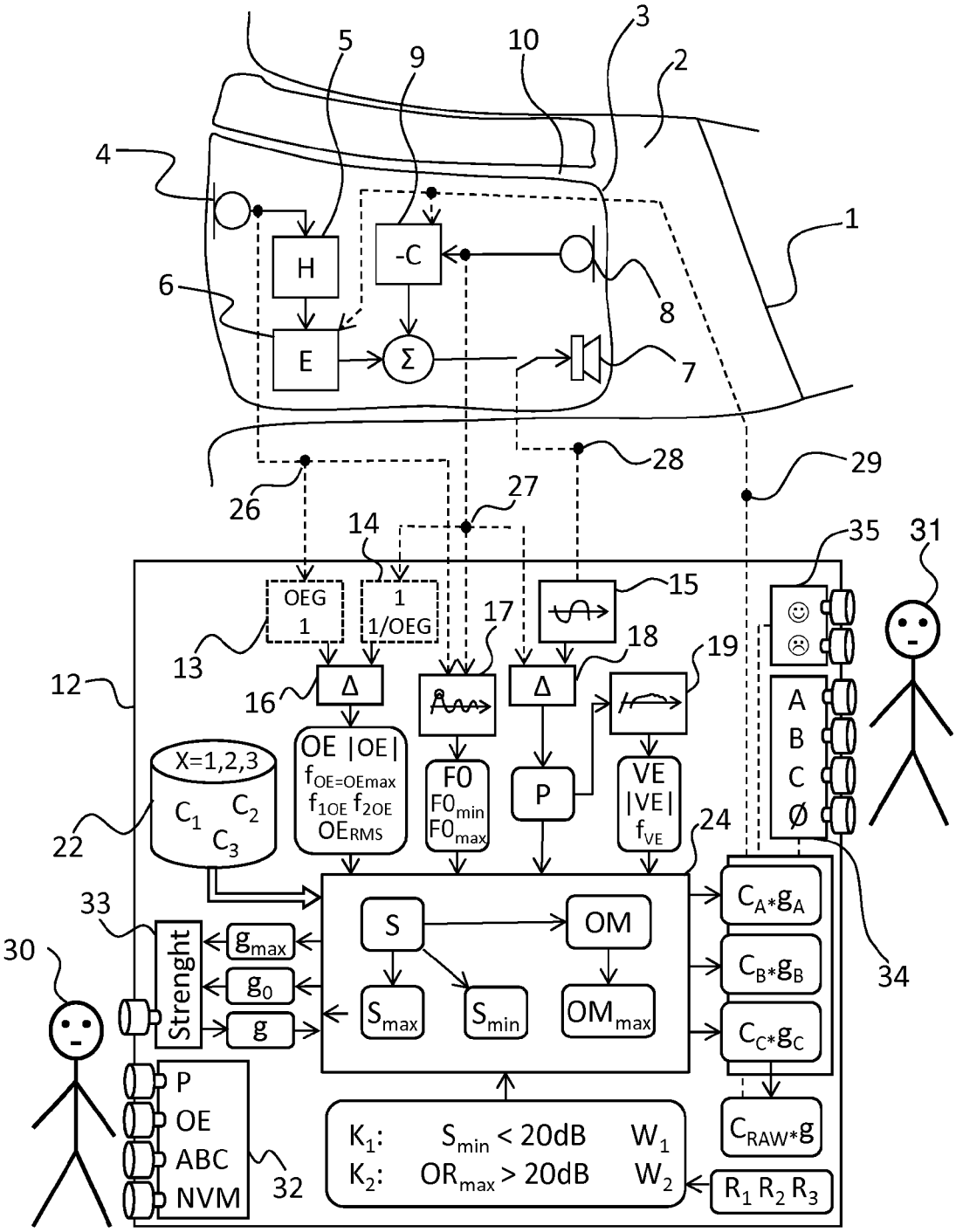
FIG. 3 is a diagram showing a hearing aid and a fitting device configured for carrying out the fitting method of the invention.

FIG. 3 shows a schematic representation of a hearing aid 3 and a fitting device 12 configured for carrying out the fitting method of the invention. The hearing aid 3 and the fitting device 12 are configured for communicating with each other.

The shown hearing aid 3 is an ITE or in-the-ear hearing aid for compensating a hearing loss. As already indicated, the invention may also be applied for a hearing protection device such as a Serenity DP+ by Phonak™. The hearing aid device fitted according to the invention may also be a distributed or modular hearing aid device. Such a hearing aid device may have a behind-the-ear module as well as an in-the-ear module. The modules are generally electrically connected to each other. The in-the-ear module preferably comprises both the receiver 7 and the canal microphone 8. It is preferable to arrange both transducers in the canal because sound tubes to modules at other locations would introduce delays in the active occlusion control loop which would interfere with its proper functioning. The in-the-ear module may be a custom ear-piece or a one-size-fits-all dome. The vent 10 in an ear-piece of a modular hearing aid or in the main body of an ITE hearing aid has preferably a diameter in a range from 0.6 mm to 1.2 mm, in particular 0.8 mm or 1.0 mm. Larger vents may cause feedback problems and impair sound cleaning features. Smaller vents may be prone to plugging and may not provide sufficient pressure equalization and moisture discharge. If the fitting method is carried out in regard to a plurality of users it is advantageous to use the same vent size each time and to accommodate personal preferences by the selection and scaling of the compensator filter dataset C. A hearing protection device has preferably no vent at all to provide maximum noise attenuation. Even though only one hearing aid 3 is shown a typical user will have two hearing aids. Each of them may be fitted as described in this document, in particular one after the other. However, certain steps may be carried out left and right simultaneously and/or in a synergic manner, as for example the measurement of the complex objective frequency-dependent occlusion effect function OE. The same stimulus presentation may be used for measurements at the left and the right hearing aid. Further, results from left and right may be compared for plausibility checks and/or may be combined for obtaining a higher precision. For example the signals of left and right outside microphones may be averaged or be selectively used depending on which signal is best.

The fitting device 12 is represented in FIG. 3 logically rather than physically. Blocks, such as the "plant measurement analysis means 18" are preferably not physical units, but instead algorithms or software stored in a memory of a computer. User controls such as the "strength selector user control 33" may be graphical user interface elements on a display such as a slider operable by a mouse or touch screen. User controls may be provided for adjusting parameters and/or entering data such as g, $g_{target}$, $g_{max}$, $S_{thres}$, $S_{target}$, $S_{bound}$, $f_{target}$, $f_{1S}$, $f_{2S}$, $f_{\varphi Target}$, $f_{1\varphi}$, $f_{2\varphi}$, P, OE, |OE|, $f_{OE=OEmax}$, $f_{10E}$, $f_{20E}$, $OE_{RMS}$, VE, |VE|, $f_{VE}$, F0, $F0_{min}$, $F0_{max}$, $\{W_1, W_2, \ldots\}$ and/or $\{R_1, R_2, R_3 \ldots\}$. In generic terms, the fitting device 12 is preferably a device or system comprising a memory and a processor, wherein a fitting software is storable in the memory and executable by the processor. Typically the fitting device 12 would be a desktop personal computer or PC with a Microsoft Windows™ operating system and a fitting software, such as Target by Phonak™, communicating via a wireless interface such as Bluetooth™ with a fitting interface device such as NOAHLink™ by HIMSA or an iCube by Phonak™, which fitting interface device in turn communicates wirelessly or by electrical wires with one or two hearing aids 3. NOAHLink™ is normally worn like a medal on a neckband by the patient or user 31. Instead of a desktop PC other computers may be used, such as laptop computers, notebook computers or tablet computers. The fitting device 12 may be operated by a fitter 30, the hearing aid user 31 or by both of them. Typically, the fitter is an audiologist. However, it may also be a salesperson, an ENT-doctor, a general practitioner, a caretaker, a nurse, a teacher, a so-called "significant other" such as a relative or any competent individual. Finally, in the case of self-fitting, the fitter 30 may be the hearing aid user 31 him- or herself. If more than one individual is involved in the fitting, separate screens and input devices may be provided for them. The fitting device 12 may also be smartphone, cellular phone and/or cordless phone. It may also be an assisted living device, which is a multifunctional device for supporting aged or handicapped people and may integrate functions such as an emergency alarm button, medical body parameter supervision and GPS tracking. It may further be a hearing aid remote control and/or it may be fully or partially integrated in the hearing aid 3, in particular in an earpiece or a behind-the-ear module of it. The fitting device 12 may also be configured for remote or distance fitting. In this case at least part of the fitting device 12 is at a location remote from the hearing aid 3. For example, the user 31 may be at his home, while the fitter 30 is in a call center or office, which may be in another building and/or several kilometers away. The fitting software and/or the fitting data may be fully or partially stored, processed and/or executed on a web server or in a cloud computing manner.

The system is configured for obtaining the complex frequency-dependent plant transfer function P based on a plant measurement and for using it in the determination of the compensator filter dataset C. The plant measurement is carried out with the hearing aid inserted (in-situ) and preferably, if there is a vent, with an open vent. Only if there is substantial environment noise it may be advantageous to close the vent.

However, environment noise may also be dealt with by louder plant stimuli. The user 31 is instructed to remain silent during the measurement. The measurement is similar to a feedback measurement. Hence, it may also be advantageously combined with it, in particular such that both measurements are carried out upon a single user or fitter action. The measurement may in particular be started by the fitter 30 by selecting the option "P" on a mode selector control 32, which in turn may switch the system into a plant measurement mode. For the plant measurement, the receiver 7 may be disconnected physically or logically from the hearing aid sound processing means 5, 6 and 9 and may be connected to a signal 28 provided by a plant stimulus generation and/or playback means 15. Different kinds of stimuli may be used, in particular artificially generated stimuli (AGS), recorded real life sound stimuli (RRS), current environment sound stimuli (CES) and/or stimuli generated based on sounds provided by an external device other than the fitting device 12 (EDS). Artificially generated stimuli may include broadband stimuli, such as pink noise and white noise, as well as tonal stimuli, such as stepped or swept sine or complex multi-sine stimuli. An example of a white noise stimulus is a PRBS stimulus (pseudorandom binary sequence) and in particular an MLS (maximum length sequence) stimulus. Recorded real-life stimuli may include music, nature sounds, such as sounds of a waterfall, voice or own voice of the user. Recorded real life stimuli are perceived by the hearing aid user 31 as being more pleasant and entertaining than artificially generated stimuli. The provision of recorded real life stimuli may be carried out by a hearing aid manufacturer and may comprise the steps of picking up environment sounds in the field with a microphone and storing them on a medium such as a hard disk. Recorded real life stimuli may be enhanced by combining them with other stimuli, in particular artificial ones. This allows for example to assure that all frequencies are sufficiently covered by the stimulus. Current environment sound may be used processed or unprocessed as stimulus. The external device may for example be a hi-fi system. Sounds may be transmitted and/or streamed from the external device to the hearing aid 3 by wire or wirelessly, either directly, or indirectly through the fitting device 12 and/or a streaming device such as an iCOM by Phonak™. The sounds may be used processed or unprocessed as stimuli. Finally the plant stimulus may be any result of filtering and/and combining of stimuli such as for example defined by $$FCS=\alpha*AGS+\beta*RRS+\gamma*CES+\delta*EDS$$

Wherein α, β, γ and δ may be scalars and/or filters. Plant measurement analysis means 18 may calculate a difference of a logarithmic frequency domain representation of the resulting sound and a logarithmic frequency domain representation of the plant stimulus sound. Alternatively a quotient may be calculated of non-logarithmic representations of these sounds. A frequency analysis method may be used, in particular with tonal stimuli. A correlation method may be used, in particular with broadband stimuli. An adaptive algorithm, e.g. a LMS-algorithm (Least-Mean-Squares), may be used if there is no generated stimulus or if a processed or unprocessed environment sound is used as stimulus. More details about such calculations can be found in textbooks about "system identification". A plausibility check may be carried out for P, in particular for detecting if a wax protection system of receiver 7 and/or microphone 8 is clogged. Preferably the complex frequency-dependent plant transfer function P is measured directly. However, it is also possible to measure only the magnitude |P| of the plant transfer function P and to estimate a phase function $\phi=\arg(P)$ e.g. by minimum phase considerations, Hilbert transformation and/or application of a sound propagation delay between receiver and microphone. "Complex" may be defined as "including phase information". It can be advantageous to subdivide the frequency range of the plant measurement, e.g. at 350 Hz, in order to have more low-frequency measurement points at a given FFT (fast Fourier transformation) size for better determining the low frequency overshoot described further down.

The system is further configured for determining the compensator filter dataset C based on an objective frequency-dependent occlusion effect function and/or based on at least one property of it. The function may be a complex function OE or a magnitude function |OE|. The property may be a peak frequency $f_{OE=OEmax}$ at which the occlusion effect magnitude has its maximum or the relevant maximum. It may be also be a substantial occlusion effect frequency range $\{f_{10E}, f_{20E}\}$ in which the occlusion effect is above a threshold and/or in which the occlusion effect is substantially at its maximum. It may also be a root mean square value $OE_{RMS}$ of the objective frequency-dependent occlusion effect function. The property may refer to the full frequency range of OE. However, it may also refer to a certain part of the frequency range.

The objective frequency-dependent occlusion effect function and/or the at least one property of it may be obtained based on a measurement while the voice of the user 31 is active and while there are preferably no other outside sounds. The hearing aid 3 is preferably muted, for example by switching off the receiver. The user's voice may be activated by instructing him or her to speak freely, read a text, repeat a word or sentence, ask a question, sweep a vowel and/or speak different vowels. The measurement may be started by the fitter 30 by selecting the option "OE" on a mode selector control 32, which in turn switches the system into an occlusion measurement mode. The voice of the user may be picked up as a canal sound by canal microphone 8 and as a reference sound by a reference microphone, for example the outside microphone 4, an outside microphone of a further not shown hearing aid or any microphone connected to the fitting device 12. The corresponding signals 26 and 27 are transmitted to the fitting device 12. An open ear gain compensation "OEG" may be applied to the reference sound by compensation means 13 thereby obtaining a compensated outside sound. Alternatively, an inverse open ear gain compensation "1/OEG" may be applied to the canal sound by compensation means 14 thereby obtaining a compensated canal sound. Occlusion measurement analysis means 16 may calculate a difference of a logarithmic frequency domain representation of the canal sound or, as the case may be, the compensated canal sound and a logarithmic frequency domain representation of the reference sound or, as the case may be, the compensated reference sound. Alternatively a quotient may be calculated of non-logarithmic representations of these sounds. If no OEG compensation has been applied yet, it may still be applied to the resulting difference or quotient, or it may not be applied at all since an OEG is usually not much different from 0 dB in the relevant frequency range below 1 kHz.

Instead of activating and measuring the user's voice, an artificial own voice stimulus may be applied in an occlusion effect measurement. The body of the user may be vibrated by vibrating means. Such means may comprise a body stimulus generator and, connected to it, an electromechanical transducer such as a bone conduction headset. A canal sound resulting from such a vibration in the occluded ear canal is picked up by the canal microphone 8. The signal of the outside microphone 4 is ignored. Instead the signal of the body stimulus generator is used as reference sound. In the further processing the sound in the open ear canal can be estimated by applying a compensation to the reference sound similar to the OEG compensation described above. Accordingly, instead, an inverse compensation may be applied to the canal sound or no compensation may be applied at all. Since the vibration stimulus is reproducible, in contrast to the user's voice, a second, subsequent measurement may be carried out with a probe tube in the canal and without hearing aid 3, thereby obtaining a more precise open ear canal sound as reference sound which needs no compensation. Since the probe tube is already in place, the occluded canal sound may be also measured with the probe tube instead of the canal microphone 8.

In embodiments with a vent 10, the objective frequency-dependent occlusion effect function and/or the at least one property of it may refer to the occlusion with open or closed vent. Hence, in the strict sense OE is either $OE_{Vented}$ or $OE_{Unnvented}$. The same applies accordingly for |OE| and the properties of OE. In many cases it is irrelevant which OE is regarded. $OE_{Vented}$ is typically only in the low frequencies affected by the vent effect. In a particular embodiment primarily $OE_{Vented}$ is used, and is, if necessary derived from $OE_{Unvented}$ by adding the vent effect. For measuring $OE_{Unvented}$ the vent may be temporarily closed.

The objective frequency-dependent occlusion effect function and/or the at least one property of it may also be entered directly by the fitter 30 or user 31. Alternatively fitter 30 or user 31 may enter data from which it can be derived or which can be used in deriving it. The objective frequency-dependent occlusion effect function and/or the at least one property of it may further be obtained by an estimation based on personal and/or hearing aid device data, in particular the size of a residual space between the earpiece of the hearing aid 3 and the eardrum 1, a middle ear compliance and/or an effective leakage. The residual space depends on the penetration depth of the hearing aid earpiece and the ear canal geometry, which can be determined by an impression or scan. The middle ear compliance may be measured by tympanometry. The effective leakage may depend on the weight and/or material of the hearing aid earpiece. If there is no vent, the effective leakage may be determined based on a real ear occluded gain (REOG) measurement. Finally, in a simplified embodiment one average objective frequency-dependent occlusion effect function may be stored in the fitting device 12 and may be used for all fittings.

The system may also be configured for determining the compensator filter dataset C based on a frequency-dependent vent effect and/or leakage function of an earpiece of the hearing aid 3. The function may be specified by a complex function VE, a magnitude function |VE| or simply by a cutoff frequency $f_{VE}$ of a high-pass filter approximation of such a function. The vent effect information can be manually entered. It can also be measured. It can further be derived from the complex frequency-dependent plant transfer function P, in particular by analyzing a roll-off of the complex frequency-dependent plant transfer function P and/or by applying a low-frequency fitting method of a filter, e.g. $2^{nd}$ order, in regard to the complex frequency-dependent plant transfer function P. The derivation may be carried out by vent effect and/or leakage derivation means 19. Vent effect is caused by the penetration of sound through the vent 10. Leakage occurs when the hearing aid 3 does not exactly fit the ear canal 2, for example because it is not correctly positioned or the canal has changed since the ear impression for manufacturing the earpiece was taken. Vent effect and leakage may be added to each other for defining a so called "effective vent". The vent effect and/or leakage function may therefore also be called "effective vent function".

The system may also be configured for determining the compensator filter dataset C based on a fundamental frequency F0, a fundamental frequency range $\{F0_{min}, F0_{max}\}$ and/or a fundamental spectrum $F0_{Spectrum}$ of the voice of the user 31. This information can be manually entered. It can also be estimated based on data relating to gender and/or age of the user 31. F0 of males is about 125 Hz, F0 of females about 250 Hz and F0 of children about 440 Hz. F0 and the range $\{F0_{min}, F0_{max}\}$ can further be measured by sensing the voice of the user by outside microphone 4 and/or canal microphone 8. The hearing aid 3 is preferably muted during the measurement. The measurement can be carried out together with the measurement of the objective frequency-dependent occlusion effect function or properties of it, i.e. the same recorded sound data is used for both, determining F0 and/or the range $\{F0_{min}, F0_{max}\}$ and determining OE, |OE|, $f_{OE=OEmax}$, the range $\{f_{10E}, f_{20E}\}$ and/or $OE_{RMS}$. The determination of F0 and the range $\{F0_{min}, F0_{max}\}$ may be carried out by voice measurement analysis means 17. For measuring the range $\{F0_{min}, F0_{max}\}$ the user may be instructed to speak in pitch and/or loudness varying way, for example a German speaking user may be instructed to ask a question, at the end of which the pitch is generally higher. F0 and the range $\{F0_{min}, F0_{max}\}$ may also be acquired in a loudness dependent manner, for example by acquiring the values $F0_{soft}$, $F0_{mid}$ and $F0_{loud}$ or by acquiring a level dependent function $F0_L(L_{dB})$, wherein $L_{dB}$ is a loudness level in decibels or a loudness level class index. F0 is typically higher for louder voice. In a particular embodiment the range $\{F0_{min}, F0_{max}\}$ is defined such that it accommodates $F0_{soft}$, $F0_{mid}$ and optionally $F0_{loud}$.

The above mentioned measurements are preferably carried out during a fitting session, while there is a data connection between the fitting device 12 and the hearing aid 3 and while the user 31 is in a fitting room or a soundproof both. However, it is also possible that these measurements are carried out in the field, during normal use of the hearing aid 3, at particular times, temporarily and/or in fully continuous manner. A sound situation analysis means may determine which parameter can be measured in a particular situation. For example OE and F0 may be measured in quiet environments, while the user is speaking loudly. P may be measured while the user 31 is quiet, the environment is quiet and loud sounds are presented to him or her by the hearing aid 3, as for example when sounds are streamed from a television with muted loudspeakers. Such measurement results may be used instantaneously for automatically readjusting the compensator filter dataset C in the field. However, they may also be stored in the hearing aid 3 for a later, more controlled use during a fitting session. Accordingly, the fitting device 12 may be configured for reading out such measurement results from the hearing aid 3.

The fitting device 12 may comprise a database 22 with a set of raw compensator filter dataset candidates $\{C_1, C_2, C_3 \ldots\}$. Raw compensator filter dataset candidates may be represented in different ways as described further below. The term "raw" is used because the datasets are usually further processed and in particular scaled before they are applied in the filter 9 as also described further below. However, the term "raw" in this document is not meant to imply that there must be further processing. In addition, the raw datasets may be a result of a preprocessing, hence they may be only "raw" in respect to a certain stage of the fitting method. The raw candidates may in particular have peak magnitude of 0 dB, which guarantees stability if they are applied unprocessed. The set of candidates is generic in that it is not defined for a particular user. The set of candidates is preferably predefined, for example by a hearing aid manufacturer and/or fitting software provider. It may be distributed together with a fitting software or separately, for example on a compact disk or over the internet. Typically the database remains unchanged after the fitting software has been installed or updated and in particular after the fitting in regard to a particular user has started. The set may comprise one or more candidates. For implementing the concept of choosing between candidates a set of two candidates is sufficient. A reasonable number of candidates may be about fifty. However, memory and processing power of a standard computer may allow thousands or millions of candidates. Therefore it is possible to provide candidates even for very rare user profiles. The predefinition of candidates may be based on statistical and/or empirical data. Hypothetical or real fittings or compensator filter datasets may be determined for typical hearing aid device and user profiles and may be evaluated based on criteria as described further below in regard to the candidate selection. The predefinition of candidates may also comprise the steps of providing a set of base filters $\{C_{B1}, C_{B2}, C_{B3} \ldots\}$ and a set of modification filters $\{C_{M1}, C_{M2}, C_{M3} \ldots\}$. Each base filter can then be combined with each subset of modification filters to determine a candidate. For example candidates may be defined as follows:

$$C_1=C_{B1}\ C_7=C_{B2}*C_{M1}*C_{M3}\ C_{15}=C_{B4}*C_{M2}*C_{M4}$$

Such combinations may be calculated in advance and be provided with the fitting software. However, they may also be calculated at runtime. There may also be separate sets of dataset candidates for different user groups, such as for children, females and males. A lookup table may be used to link user groups with sets.

The fitting device 12 may comprise a candidate selection means 24. In a particular embodiment such a selection may result directly in a compensator filter dataset C for use in the hearing aid 3. However, in a preferred embodiment a preferred raw compensator filter dataset $C_{RAW}$ or set of preferred raw compensator dataset candidates $\{C_A, C_B, C_C, \ldots\}$ is obtained by choosing candidates from the set of raw compensator filter dataset candidates $\{C_1, C_2, C_3 \ldots\}$.

The preferred candidate or candidates are preferably chosen taking into account the complex frequency-dependent plant transfer function P, the objective frequency-dependent occlusion effect function and/or the at least one property of it, i.e. OE, |OE|, $f_{OE=OEmax}$, $\{f_{10E}, f_{20E}\}$ and/or $OE_{RMS}$, and optionally the frequency-dependent vent effect and/or leakage function VE, |VE| or a cutoff frequency $f_{VE}$ of a high-pass filter approximation of such a function, as well as the fundamental frequency F0 and/or fundamental frequency range $\{F0_{min}, F0_{max}\}$.

The quality of a candidate is preferably assessed by applying a selection criterion K or a set of selection criteria $\{K_1, K_2, \ldots\}$. The criterion or at least one criterion of the set of criteria is preferably a property of—or is based on one or more properties of—a complex frequency-dependent candidate specific sensitivity function S and/or a complex frequency-dependent candidate specific occlusion modification function OM. S may be defined by $$S = \frac{1}{1 + P * C_x * g_{prov}}$$

wherein P is the complex frequency-dependent plant transfer function, Cx is the $X^{th}$ candidate of the set of raw compensator filter dataset candidates $\{C_1, C_2, C_3 \ldots\}$ and $g_{prov}$ is a provisional scalar scaling factor. An example of S is discussed referring to FIG. 4 further down. OM may be defined by $$OM=VE*S$$

wherein VE is the complex vent effect and/or leakage function.

The provisional scaling factor $g_{prov}$ is provisional in that it is only used for applying the selection criteria, i.e. used for calculating certain values as shown in the criteria table below. It is a purely theoretical value and is not necessarily applied in the actual hearing aid 3. It must therefore not fulfill stability criteria. There are amongst others the following nonexclusive options:

- The provisional scaling factor $g_{prov}$ may be set to a maximum value $g_{max}$ at which the system is just still stable. This has the advantage that the criteria are applied based on a scaling factor g which can later be used in the actual hearing aid 3. The determination of $g_{max}$ is described further down.
- The provisional scaling factor $g_{prov}$ may be set to a target value $g_{target}$ which may be derived from a target minimum occlusion modification $OM_{target}$ or a target minimum sensitivity $S_{target}$ (See also FIG. 4). Oftentimes such targets cannot be reached due to stability issues. Hence, the scaling factor g used for configuring the actual hearing aid 3 will typically be smaller than $g_{target}$ and will be in particular be $g_{max}$. The determination of $g_{target}$ can be carried out in a similar manner as the determination of $g_{max}$ described further down;
- The provisional scaling factor $g_{prov}$ may be set to 1, thereby effectively eliminating $g_{prov}$ from the above formulas. In this case the database 22 may advantageously contain already scaled compensator filter datasets, and in particular differently scaled compensator filter datasets, for different typical plant characteristics;
- The provisional scaling factor $g_{prov}$ may be set to the scaling factor g which is later used in the actual hearing aid 3. It would thereby be, in fact, not a provisional value anymore;
- The provisional scaling factor $g_{prov}$ may be set to a manually selected value, in particular a value selected by the fitter 30 and/or the user 31.

The following table contains examples of selection criteria:

| Symbol | Description/Formula(s)/Quality/Parameter |
|---|---|
| $S_{min}$ | Minimum sensitivity magnitude<br>$S_{min} = \min(\lvert S_1\rvert, \ldots, \lvert S_N\rvert)$<br>Small values and values below $S_{thres}$ indicate good quality;<br>Values matching well $S_{target}$ indicate good quality.<br>$S_k$ is a sensitivity at frequency with index k; N is the highest index;<br>$S_{thres}$ is a threshold, in particular −20 dB or in a range {−10, −30} dB;<br>$S_{target}$ is a target minimum sensitivity. |
| $\lvert\Delta S\rvert$ | Absolute value of a difference between $S_{min}$ and $S_{target}$<br>$\lvert\Delta S\rvert = \lvert S_{min} - S_{target}\rvert$<br>Small values indicate good quality;<br>See also parameters of $S_{min}$ above |

-continued

| Symbol | Description/Formula(s)/Quality/Parameter |
|---|---|
| $S_{max}$ | Maximum sensitivity magnitude<br>$S_{max} = \max(\lvert S_1\rvert, \ldots, \lvert S_N\rvert)$<br>Values above $S_{bound}$ may cause substantial artifacts and poor robustness against destabilization.<br>$S_k$ is a sensitivity at frequency with index k; N is the highest index;<br>$S_{bound}$ is in particular in the range of 4 to 6 dB, or about 5 dB. |
| $S_{int}$ | Integral over sensitivity magnitude, wherein both magnitude and frequency are regarded in a perceptive manner, in particular logarithmically, such that more weight is given to low frequencies. This criterion has the advantage that VE needs not to be regarded. It provides the same result as an integral over OM since the VE comprised in OM adds the same amount of area for each candidate.<br>$S_{int} = \int_{f_{min}}^{f_{max}} \lvert S\rvert_{dB}\, df_{log}$<br>$\lvert S\rvert_{dB} = 20 * 1\log_{10}(\mathrm{abs}(S))$<br>Small values indicated good quality.<br>$\{f_{min}, f_{max}\}$ is a substantial frequency range in which $\lvert S\rvert_{dB} < 0$ dB. |
| $S_{avg}$ | Average of magnitude of S at two or more frequencies<br>$S_{avg} = \mathrm{mean}(\lvert S_1\rvert \ldots \lvert S_N\rvert) = \frac{1}{N_{avg}} \sum_{k=1}^{N_{avg}} \lvert S_k\rvert$<br>Small values at frequencies relevant for occlusion control indicate good quality.<br>$S_k$ is a sensitivity at frequency with index k; $N_{avg}$ is the highest index; A preferred set of frequencies is {125 Hz, 250 Hz, 500 Hz} or {100 Hz, 125 Hz, 160 Hz, 200 Hz, 250 Hz, 315 Hz, 400 Hz, 500 Hz} |
| $S_{sum}$ | Sum of magnitude of S at two or more frequencies<br>$S_{sum} = \sum_{k=1}^{N_{sum}} \lvert S_k\rvert$<br>Small values at occlusion frequencies relevant for occlusion control indicate good quality.<br>$S_k$ is a sensitivity at frequency with index k; Nsum is the highest index; See also parameters of $S_{avg}$ above |
| $\Phi_{max}$ | Maximum sensitivity phase<br>$\Phi_{max} = \max(\Phi_1, \ldots, \Phi_N)$<br>$\Phi_k = \arg(S_k) = \arctan\left(\frac{\mathrm{Im}(S_k)}{\mathrm{Re}(S_k)}\right)$<br>Small values indicated good quality.<br>$\Phi_k$ is a phase at frequency with index k;<br>$S_k$ is a sensitivity at frequency with index k; N is the highest index. |
| $SS_{max}$ | Maximum sensitivity steepness<br>$SS_{max} = \max\left(\frac{dS_1}{df}, \ldots, \frac{dS_N}{df}\right)$<br>Small values indicate good quality;<br>Values below a threshold of 20 dB per decade indicate good quality.<br>dS/df is a derivative of sensitivity S with respect to frequency f. |
| $\Delta f$ | Bandwidth of a substantial frequency range in which $\lvert S\rvert_{dB} < 0$ dB<br>$\Delta f = f_{max} - f_{min}$<br>Large values indicated good quality.<br>$\lvert S\rvert_{dB}$ is a magnitude of S represented in decibels;<br>$f_{min}$, $f_{max}$ are bounds of said substantial frequency range. |
| $f_{S-Smin}$ | Frequency at which a magnitude of the sensitivity S has its minimum<br>$\lvert S(f_{S=Smin})\rvert = S_{min}$<br>Values matching well F0 or $f_{target}$ indicate good quality;<br>Values fitting into $\{F0_{min}, F0_{max}\}$ indicate good quality;<br>Values fitting into $\{f_{1S}, f_{2S}\}$ indicate good quality;<br>Values matching well a function $f_x(f_{VE})$ indicate good quality;<br>Values matching well a product $x * f_{VE}$ indicate good quality.<br>F0 is a fundamental frequency of a voice of the user;<br>$\{F0_{min}, F0_{max}\}$ is a fundamental frequency range of the voice;<br>$f_{target}$ is target frequency, in particular 200 Hz;<br>$\{f_{1S}, f_{2S}\}$ is a target frequency range, in particular 80 to 500 Hz;<br>$f_x(.)$ is a function depending on $f_{VE}$, for example $f_x(f_{VE}) = 0.8 * f_{VE}$;<br>$f_{VE}$ is a cutoff frequency $f_{VE}$ of a high-pass filter approximation of a frequency-dependent vent effect and/or leakage function VE; |

-continued

Figure 4:
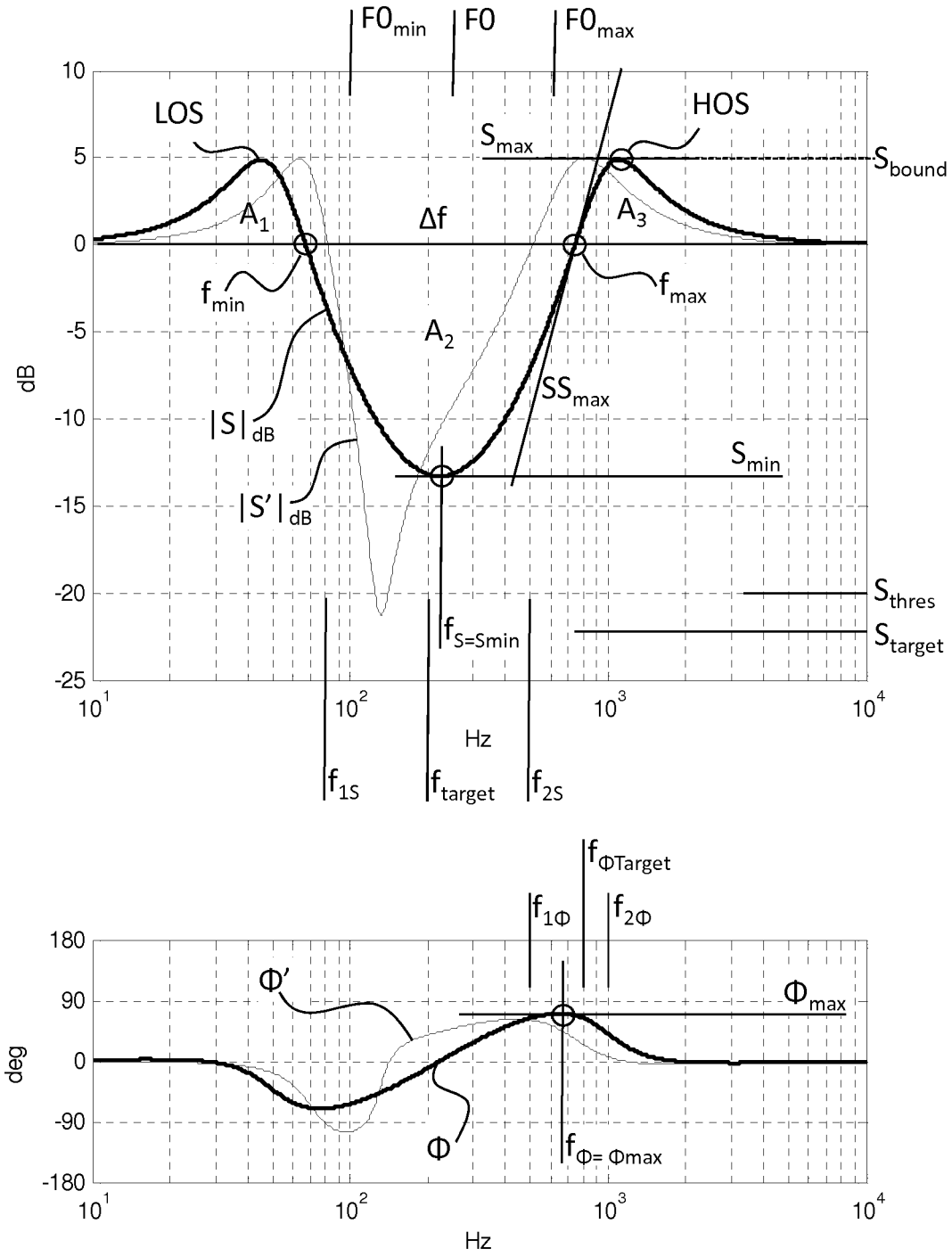
FIG. 4 is a Bode plot showing two different complex sensitivity functions.

| Symbol | Description/Formula(s)/Quality/Parameter |
|---|---|
| | x is a factor, in particular 60 to 100%, in particular ca. 80%;<br>Examples of $f_{target}$, $f_{1S}$ and $f_{2S}$ are shown in Fig. 4. |
| $f_{\Phi=\Phi max}$ | Frequency at which the phase Φ of the sensitivity S has its maximum<br>$\Phi(f_{\Phi=\Phi max}) = \arg(S(f_{\Phi=\Phi max})) = \Phi_{max}$<br>Values matching well $f_{\Phi Target}$ indicate good quality;<br>Values fitting into $\{f_{1\Phi}, f_{2\Phi}\}$ indicate good quality.<br>$f_{\Phi Target}$ is a target frequency, in particular 800 Hz;<br>$\{f_{1\Phi}, f_{2\Phi}\}$ is a target frequency range, in particular 500 to 1000 Hz;<br>Examples of $f_{\Phi Target}$, $f_{1\Phi}$ and $f_{2\Phi}$ are shown in Fig. 4. |
| 1/OE | Inverse of the function OE<br>1/OE<br>$OE = OE_{vented}$ $OE = OE_{unvented} * VE$<br>A sensitivity function S matching well 1/OE indicates good quality.<br>$OE_{vented}$ is the objective complex frequency-dependent occlusion effect function measured with open vent. |
| $f_{OE=OEmax}$ | Peak frequency of the magnitude of OE<br>$\lvert OE(f_{OE=OEmax})\rvert = OE_{max}$<br>$OE_{max} = \max(\lvert OE_1\rvert, \ldots, \lvert OE_N\rvert)$<br>The above $f_{S=Smin}$ matching well $f_{OE=OEmax}$ indicates good quality.<br>$OE_k$ is a value of OE at particular frequency with index k;<br>N is the highest index; OE is the objective complex frequency-dependent occlusion effect function. |
| $\left\{\begin{matrix} f_{1OE} \\ f_{2OE} \end{matrix}\right\}$ | Peak frequency range of the magnitude of OE, substantial occlusion effect frequency range in which a magnitude of OE is above $OE_{thres}$ and/or in which a magnitude of OE is substantially $OE_{max}$<br>$\lvert OE(f_{1OE} \ldots f_{2OE})\rvert, \approx OE_{max}$<br>$OE_{max} = \max(\lvert OE_1\rvert, \ldots, \lvert OE_N\rvert)$<br>$\lvert OE(f_{1OE} \ldots f_{2OE})\rvert > OE_{thres}$<br>$\{f_{min}, f_{max}\}$ matching well $\{f_{1OE}, f_{2OE}\}$ indicates good quality;<br>$OE_k$ is a value of OE at particular frequency with index k; N is the highest index; $OE_{thres}$ is a threshold; $\{f_{min}, f_{max}\}$ is a substantial frequency range in which $\lvert S\rvert_{dB} < 0$; OE is the objective complex frequency-dependent occlusion effect function. |
| $OE_{RMS}$ | Root mean square value of OE<br>$OE_{RMS} = \sqrt{\frac{1}{N}(\lvert OE_1\rvert^2 + \lvert OE_2\rvert^2 + \ldots + \lvert OR_N\rvert^2)}$<br>$S_{RMS} = \sqrt{\frac{1}{N}(\lvert S_1\rvert^2 + \lvert S_2\rvert^2 + \ldots + \lvert S_N\rvert^2)}$<br>$S_{RMS}$ matching well $OE_{RMS}$ indicates good quality.<br>$OE_k$ is a value of OE at particular frequency with index k;<br>$S_k$ is a sensitivity at frequency with index k; N is the highest index;<br>OE is the objective complex frequency-dependent occlusion effect function. |
| $OM_{min}$ | Minimum of the OM<br>$OM_{min} = \max(\lvert OM_1\rvert, \ldots, \lvert OM_N\rvert)$<br>$\lvert OM\rvert = \lvert VE\rvert_{dB} + \lvert S\rvert_{dB}$<br>OM = VE * S<br>Small values indicated good quality;<br>Values below $OM_{thres}$ indicate good quality.<br>$OM_k$ is a value of OE at a particular frequency with index k; N is the highest index; $\lvert OM\rvert$ is the frequency-dependent magnitude of OM;<br>$\lvert VE\rvert_{dB}$ is a frequency-dependent magnitude of VE expressed in dB;<br>$\lvert S\rvert_{dB}$ is a frequency-dependent magnitude of S expressed in dB;<br>VE is a complex representation of the frequency-dependent vent effect and/or leakage function. It is the same for all candidates;<br>$OM_{thres}$ is a threshold of about −20 dB or of about −10 to −30 dB;<br>OM is the complex frequency-dependent occlusion modification function. |
| $OM_{avg}$ | Average of magnitude of OM at two or more frequencies<br>$OM_{avg} = \text{mean}(\lvert OM_1\rvert, \ldots, \lvert OM_N\rvert) = \frac{1}{N_{avg}} \sum_{k=1}^{N_{avg}} \lvert OM_k\rvert$<br>Small values at occlusion frequencies indicate good quality.<br>See parameters of $S_{avg}$ and $OM_{min}$ above. |

In the specification of the criteria the expression "matching well" is used for describing the relation between a first and a second measure. If both measures are scalars, e.g. decibel values or frequencies, "matching well" means that the absolute value of their difference is small. If both measures are frequency ranges "matching well" means that the lower and upper bounds match well. If both measures are functions "matching well" may in particular mean that an application of the method of least squares indicates a good matching of the two functions.

When carrying out the task of determining one preferred candidate $C_{RAW}$ or a set of preferred candidates $\{C_A, C_B, C_C, \ldots\}$ by applying a criterion K and by choosing from the available compensator filter dataset candidates $\{C_1, C_2, C_3 \ldots\}$, a quality indicator may be calculated for each candidate thereby obtaining a set of quality indicators $\{Q_1, Q_2, Q_3 \ldots\}$. A quality indicator may be a numeric representation of a property defined by a criterion K. Depending on the property small or large values may indicated good quality. It may also be a category such as "poor", "average", "good" or the like. The quality indicator $Q_1$ for a candidate $C_1$ and a criterion K, namely "Smallness of $S_{min}$", may be defined by:

$$Q_1 = S_{min}(C_1) \text{ or } Q_1 = f_Q(S_{min}(C_1))$$

The function $f_{Q(\cdot)}$ allows to derive quality indicators for properties which reflect not directly an extent of quality, for example if values in a certain range indicate good quality. It also allows to normalize the quality indicators of different criteria, for example if one property is a decibel value and another property is a Hertz value. The important feature of the quality indicator is that it provides a basis for comparing the quality of candidates. The following table shows an example:

| | K | Rank |
|---|---|---|
| $C_1$ | $Q_1 = 0.823$ | 2 |
| $C_2$ | $Q_2 = 0.945$ | 1 |
| $C_3$ | $Q_3 = 0.364$ | 3 |

The preferred raw compensator filter dataset candidate $C_{RAW}$ according to the example would be $C_2$. A set of two preferred raw compensator filter dataset candidates $\{C_A, C_B\}$ according to the example would be $\{C_1, C_2\}$.

As already indicated above, not only one criterion K may be applied, but instead a set of criteria $\{K_1, K_2, \ldots\}$. In this case a weighting may be provided for each criterion of the set of criteria thereby obtaining a set of weights $\{W_1, W_2, \ldots\}$. The weights allow to regard certain criteria more than others. The following table shows an example with three raw compensator filter dataset candidates and three weighted criteria:

| Weight | $K_1$ $W_1 = 100$ | $K_2$ $W_2 = 0.5$ | $K_3$ $W_3 = 1$ | $K_{1,2,3}$ | Rank | Eval |
|---|---|---|---|---|---|---|
| $C_1$ | $Q_{C1K1}$ | $Q_{C1K2}$ | $Q_{C1K3}$ | $Q_1 = 0.773$ | 3 | $R_1$ |
| $C_2$ | $Q_{C2K1}$ | $Q_{C2K2}$ | $Q_{C2K3}$ | $Q_2 = 0.248$ | 1 | $R_2$ |
| $C_3$ | $Q_{C3K1}$ | $Q_{C3K2}$ | $Q_{C3K3}$ | $Q_3 = 0.334$ | 2 | $R_3$ |

Multi-criteria quality indicators $Q_1$, $Q_2$ and $Q_3$ are calculated for the candidates $C_1$, $C_2$ and $C_3$. The multi-criteria quality indicator Qy for a particular $Y^{th}$ candidate Cy is determined by first calculating criterion-specific quality indicators $Q_{CYK1}$, $Q_{CYK2}$ and $Q_{CYK3}$ for the selection criteria $K_1$, $K_2$, and $K_3$ and then combining these criterion-specific quality indicators in a weighted manner by applying a weighting function $f_{W(\cdot)}$:

$$Q_Y = f_W(\{W_1, W_2, \ldots\}, \{Q_{CYK1}, Q_{CYK2}, \ldots\})$$

In a preferred embodiment the weighting function is linear and applies a weighting factor to each criterion-specific quality indicator, as shown by the following formula:

$$Q_Y = W_1 * Q_{CYK1} + W_2 * Q_{CYK2} + W_3 * Q_{CYK3}$$

However, the weighting function $f_{W(\cdot)}$ may also be a polynomial and in particular comprise quadratic terms as shown by the following example:

$$Q_Y = W_1 * (Q_{CYK1})^2 + W_{12} * (Q_{CYK1} * Q_{CYK2}) + W_{22} * (Q_{CYK3})^2 + \ldots$$

The set of weights $\{W_1, W_2, \ldots\}$ for the set of selection criteria $\{K_1, K_2, \ldots\}$ can be obtained by carrying out a subjective evaluation of each candidate of the set of raw compensator filter dataset candidates $\{C_1, C_2, C_3 \ldots\}$ by one or more individuals thereby obtaining a set of subjective evaluation results $\{R_1, R_2, R_3 \ldots\}$. The evaluation may in particular be carried out based on a scaling to a maximum stable active occlusion control strength and/or based on an adjustable scaling. The weights $\{W_1, W_2, \ldots\}$ are then set such that a set of multi-criteria quality indicators $\{Q_1, Q_2, Q_3 \ldots\}$ calculated based on the set of weights $\{W_1, W_2, \ldots\}$ substantially best matches the set of subjective evaluation parameters $\{R_1, R_2, R_3 \ldots\}$. This may comprise carrying out a regression analysis, a stepwise regression analysis, a discriminant analysis and/or a stepwise discriminant analysis.

As already indicated, the compensator filter datasets $\{C_1, C_2, C_3 \ldots\}$ stored in database 22 are "raw". Before they are actually applied as occlusion filter dataset C the hearing aid 3 they are scaled by a scaling factor g:

$$C = C_{RAW} * g \quad C = C_1 * g_1 \quad C = C_A * g_A$$

The scaling factor g influences the strength of the occlusion control. However, if g is chosen too large, the active occlusion control loop may become unstable. Accordingly, there is a maximum allowable scaling factor $g_{max}$. This value depends on the raw compensator filter data set such as $C_{RAW}$ or $C_A$ and on the complex frequency-dependent plant transfer function P of the particular individual and should therefore be recalculated if any of these parameters changes. In a preferred embodiment g is not manually adjustable but always set to $g_{max}$ such that the occlusion control is maximized while keeping the system stable. In another embodiment the scaling factor g and therefore the strength of the occlusion control is adjustable manually by the fitter 30 and/or the user 31, in particular by the strength selector user control 33. The adjustment range is preferably limited such that $g_{max}$ cannot be exceeded. Further, the g may have a particular initial value $g_0$, which can for example be $g_{max}$.

The active occlusion control loop is stable and substantially robust against destabilization if the maximum sensitivity $S_{max}$ does not exceed a predefined value $S_{bound}$. The stability of a system with feedback can be assessed based on a Nyquist plot. A distance between the Nyquist plot and the Nyquist point at (−1, i*0) is a stability criterion. The maximum sensitivity $S_{max}$ is an indicator for this distance and therefor also a stability criterion. The smaller $S_{max}$, the more robust is the system against destabilization. $S_{bound}$ is typically in the range from 4 to 6 dB, in particular at 5 dB. Preferably the system allows to redefine $S_{bound}$, since empirical tests may imply other values. $g_{max}$ may be calculated based on $C_{RAW}$, P, $S_{bound}$ and the following equations:

$$S = \frac{1}{1 + P * C_{RAW} * g}$$

$$S_{max} = \frac{1}{1 + P * C_{RAW} * g_{max}}$$

$$S_{max} = S_{bound}$$

However, since there is no formula for a direct calculation of $g_{max}$ it may be advantageous to determine $g_{max}$ by an iterative method. For example g might be increased in one dB-steps and after each increase $S_{max}$ is calculated and evaluated.

In a particular implementation of the candidate selection means 24 the user and hearing aid specific data such as P, OE, |OE|, VE, |VE|, $f_{VE}$, F0, F0$_{min}$, F0$_{max}$, age, gender, hearing loss, hearing aid coupling and hearing aid type is mapped to a finite number of categories. The preferred raw compensator filter dataset $C_{RAW}$ or the set of preferred raw compensator dataset candidates $\{C_A, C_B, Cc, \ldots\}$ is then determined without actually calculating criterion data such as $S_{min}$. Instead the candidate or candidates for the determined category are looked up in a lookup table. The lookup table may also be combined with a criterion based evaluation. Both, lookup table and criterion based evaluation may be used in an arbitrary sequence to reduce the number of candidates until a target number of candidates has been reached.

As already indicated the candidate selection means 24 may not only provide a preferred raw compensator filter dataset $C_{RAW}$ but instead also a set of preferred raw compensator dataset candidates $\{C_A, C_B, Cc, \ldots\}$ which is a subset of the set $\{C_1, C_2, C_3 \ldots\}$ stored in the database. The hearing aid 3 is then temporarily and successively configured based on candidates of this subset. Such a demonstration of candidates may be started by the fitter 30 by selecting the option "ABC" on a mode selector 32, which in turn switches the system into a demonstration mode. In a first trial the compensator filter C may be configured with $C_A$*$g_A$, in a second trial with $C_B$*$g_B$ and so forth. A particular candidate may also be demonstrated differently scaled. There may be presentations $C_A$*$g_{A1}$ and $C_A$*$g_{A2}$. An additional configuration to be evaluated may be "No AOC", i.e. without active occlusion control. At least two configurations should be presented, wherein one might be the "No AOC" configuration. However, optimally three to five configurations are presented. The user 31 may be instructed to speak, walk, chew, listen to the fitter 30 speaking or listen to a surround sound system. The user 31 and/or the fitter 30 may actively switch between the configurations by actuating a candidate selector user control 34 or the configurations may be presented automatically one after the other for a certain time and/or until a corresponding evaluation result is entered. Eventually, the fitting device 12 obtains an absolute or relative evaluation information in regard to one or more of the demonstrated configurations from the user 31. The user 31 and/or the fitter 30 may enter such information, in particular by a candidate rating user control 35. Based on the information the system determines which of the candidates $C_A$, $C_B$, Cc is the preferred candidate. The result $C_{RAW}$ or the scaled result $C_{RAW}$*g is then stored in the non-volatile memory of the hearing aid 3, in particular by selecting the option "NVM" on a mode selector control 32. The hearing aid may be then or thereby switched from the fitting mode back to the operation mode.

The compensator filter dataset C may also be determined without the above mentioned candidates, in particular by a calculation based on the equations:

$$S=(1+P*C)^{-1} \text{ and } S=S_{target}=OE^{-1}$$

or the equation:

$$C = \frac{OE - 1}{P}$$

The fitting method of according to the invention may also be used to determine more than one compensator filter data set, for example for different hearing programs or hearing situations such as a $C_{Sp}$ for speech, a $C_{SpN}$ speech in noise, a $C_C$ for calm situations and a $C_M$ for music or for different loudness levels such as a $C_S$ for soft, a $C_M$ for medium and a $C_L$ for loud. Accordingly, more than one compensator filter data set may be stored in the non-volatile memory of the hearing aid 3.

Once a compensator filter dataset C has been determined the occlusion control compensator filter 9 and the pre-equalizer 6 may be configured based on it, such that it becomes part of an active configuration of the signal processor of the hearing aid 3. This may in particular occur during the above mentioned demonstrations, at the end of the fitting session, when the hearing aid is switched on or to another program, when filter data is transmitted by a signal 29 from the fitting device 12 to the hearing aid 3 and/or when filter data is read from the non-volatile memory of the hearing aid 3.

The compensator filter datasets, such as C, $C_{RAW}$, $C_1$, $C_2$, $C_3$, $C_A$, $C_B$, $C_C$, $C_{Sp}$, $C_{SpN}$, $C_C$, $C_M$, $C_S$, $C_M$ and $C_L$, may be represented in two substantially different ways:

A first way is named here "coefficient format". It is a representation as a set of scalar filter coefficients. The filter is preferably time-discrete. Such a set may comprise or consist of coefficients of a numerator polynomial in z, for example $\{b_0, b_1, b_2, \ldots\}$, and coefficients of a denominator polynomial in z, for example $\{a_1, a_2, \ldots\}$. A simple implementation would be a "digital biquad filter". The coefficients may define a filter of $n^{th}$ order. A representation of C in this format is indicated below by the symbol C[cf].

A second way is named here "function format". It is a representation as a complex frequency-dependent filter function, also referred to as frequency response. Such a function is preferably frequency discrete such that the function can be described by a complex vector of a predefined dimension. A reasonable tradeoff between accuracy and data size can be achieved by a third octave frequency resolution. A higher resolution function may be filtered to obtain a function having such a resolution. Preferably, the frequency resolution applied in measurements, calculations and/or filter definitions is the same. Accordingly, the complex frequency-dependent functions P, OE, OM, VE, S and C have preferably the same frequency resolution and the corresponding vectors have the same dimension. A representation of C in this format is indicated below by the symbol C[ft].

The "coefficient format" has the advantage that it needs less memory and transmission time than the "function format". "coefficient format" data may be compressed and/or reduced to a data size of about 75 bytes, i.e. less than 100 bytes, per compensator filter dataset C. The "coefficient format" can easily be converted to the "function format". Vice versa, it is difficult and not very practical to convert the "function format" to the "coefficient format". The "function format" is much better suited for assessing the filter quality. The formulas comprising "C" in the present document, such as S=1/(1+P*C) are normally calculated based on the "function format". An exception is the scaling of a "raw" filter compensator filter dataset with a scaling factor, such as $C=C_{RAW}*g$, and the additive inversion, such as C'=−C, which can be calculated well in both formats.

In the following it is indicated which format is preferably used in which stage of the fitting process:

The predefinition of raw compensator filter dataset candidates $\{C_1, C_2, C_3 \ldots\}$ is preferably at least partially carried out based on the "function format", because the predefinition involves most likely filter quality assessments.

The storing of raw compensator filter dataset candidates $\{C_1, C_2, C_3 \ldots\}$ in the database 22 is preferably carried out based on the "coefficient format" because of memory and convertibility considerations. However, the candidates may be stored additionally in the "function format". This allows to save processing time during the fitting session, because it eliminates the format conversion step.

The quality assessment and candidate selection by the fitting device 12 is preferably carried out based on the "function format".

The transmission to the hearing aid 3 as well as the signal processing within the hearing aid 3 as well as the storing in the non-volatile memory of the hearing aid 3 is preferably carried out based on the "coefficient format" because of data size considerations and its suitability as a basis for signal processing.

In the candidate selection process, it may be determined that a particular compensator filter dataset C[ff] is a good filter candidate and should be applied as C[cf] in the hearing aid 3. Since it is not practical to calculate C[ct] directly from C[ff] a kind of backtracking is carried out. It is determined which $C_{RAW}$%[cf] and which g compensator filter dataset C[ff] is based on. C[ct] is then calculated based on the equation $C[ct]=C_{RAW}[cf]*g$.

FIG. 4 is a Bode plot showing two different sensitivity functions S and S' which characterize two possible active occlusion control configurations for a particular user. The thick curves refer to S, the thin ones to S'. The upper diagram shows the magnitudes expressed in decibels, namely $|S|_{dB}$ and $|S'|_{dB}$. The lower diagram shows the phases, namely $\phi=\arg(S)$ and $\phi'=\arg(S')$. S results from a first compensator filter dataset candidate $C_1$ scaled with a scaling factor $g_1$. S' results from a second compensator filter dataset candidate $C_2$ scaled with a scaling factor $g_2$. The sensitivities are calculated based on the same complex frequency-dependent plant transfer function P which may have been measured for a particular user as described above.

$$S = \frac{1}{1 + P * C_1 * g_1}$$

$$S' = \frac{1}{1 + P * C_2 * g_2}$$

The magnitude function $|S|_{dB}$ can be divided into three frequency ranges. In a first range below $f_{min}$ there is the low frequency overshoot LOS. In a second range between $f_{min}$ and $f_{max}$ there is the actual occlusion reduction. In a third range above $f_{max}$ is the high frequency overshoot HOS, which is typically at 1 to 3 kHz. Occlusion reduction in a particular frequency range is always accompanied by amplification below and above this range. This behavior is called waterbed effect. More formally it is called "Bode's integral theorem". A large LOS may result in an unpleasant perception of footfall sounds. There is an area $A_1$ between the f-axis and the LOS, an area $A_2$ between the f-axis and negative section of the $|S|_{dB}$-curve and an area $A_3$ between the f-axis and the HOS. The sum of overshoot areas $A_1$ and $A_3$ is just as large as $A_2$. The area $A_2$ is equal to an absolute value $|S_{int}|$ of the above defined $S_{int}$. The larger $A_2$, the stronger the occlusion reduction. $f_{min}$ and $f_{max}$ can be defined as bordering the frequency range where $|S|_{dB}$ is below 0 dB. However, it is to be noted that $|S|_{dB}$ may also be smaller than 0 dB in small or negligible frequency ranges below and above the primary occlusion reduction frequency range. The range between $f_{min}$ and above $f_{max}$ may therefore be referred to as the "substantial frequency range where $|S|_{dB}$ is below 0 dB".

For estimating the quality of a particular sensitivity S, as already indicated above, the various properties of S, and in particular of |S|, may be regarded, for example the shown $S_{min}$, $S_{max}$, $SS_{max}$, Δf, $f_{min}$, $f_{max}$, $f_{S=Smin}$, $A_2$, $\phi_{max}$ and $f_{\phi=\phi max}$ and the not shown $S_{int}$ and $S_{RMS}$, in particular in relation to further values such as the shown $S_{thres}$, $S_{target}$, $S_{bound}$, $f_{target}$, $f_{1S}$, $f_{2S}$, $f_{\phi Target}$, $f_{1\phi}$, $f_{2\phi}$, F0, F0$_{min}$ and F0$_{max}$ and the not shown OE, |OE|, $f_{OE=OEmax}$, $f_{10E}$, $f_{20E}$, $GE_{RMS}$, VE, |VE| and $f_{VE}$.

The parameter $S_{max}$ may be treated in a special way. $S_{max}$ should not exceed the upper bound $S_{bound}$ because otherwise the system may become unstable which results typically in a whistling in the frequency range of the HOS and/or or in a rumbling in the frequency range of the LOS. Therefore the scaling factor g, i.e. $g_1$ or $g_2$, is preferably selected such that $S_{max}$ is below or at the bound $S_{bound}$. The latter applies for the two curves shown in the Bode plot, i.e. $g_1$ is equal to a maximum scaling factor $g_{1max}$ and $g_2$ is equal to a maximum scaling factor $g_{2max}$.

The parameter $S_{min}$ may also be treated in a special way. $S_{min}$ is a good indicator for the strength of the active occlusion control. A threshold $S_{thres}$ may be used to assure a minimum strength. For rendering a compensator filter dataset "preferred" $S_{min}<S_{thres}$ may have to apply. Further, a target value $S_{target}$ may be defined for $S_{min}$ to specify a target strength. $S_{min}$ depends on $g_1$. A target scaling factor $g_{target}$ can be defined as being the $g_1$ for which $S_{min}$ is equal or close to $S_{target}$. The scaling factor $g_1$ of the curve shown in the Bode plot is smaller than $g_{target}$. Accordingly $S_{min}$ is several decibels larger than $S_{target}$. Scaling the compensator filter dataset candidate $C_1$ with $g_{target}$ would result in a $S_{max}$ above $S_{bound}$. The system would show substantial artifacts and would not be substantially robust against destabilization any more. Therefor the compensator filter dataset $C_1*g_{target}$ should never be used in the actual hearing aid. However, it may be used for applying selection criteria. If this results in $C_1$ being a preferred candidate, $C_1$ would be scaled with $g_{max}$ instead of $g_{target}$ before being employed and/or evaluated in the actual hearing aid.

The parameter $SS_{max}$ indicates the maximum steepness of the magnitude curve $|S|_{dB}$. The maximum steepness is typically in the frequency range towards the HOS. A large maximum steepness should be avoided because it may cause artifacts.

It is to be noted that within this document C is defined such that the filter must be configured with "−C", i.e. with C having a negative sign, as shown in FIG. 1 and FIG. 3). However, C could be just as well defined such that the filter must be directly configured with "C". In case of such an alternative definition statements regarding C and formulas comprising C would have to be adapted accordingly. In particular the formula S=1/(1+P*C) would have to be changed to S=1/(1−P*C). Claims containing such statements and/or formulas are to be interpreted such that they cover both definitions of C. Their substantial meaning is not changed by an alteration of the definition of C. The same applies in a similar manner for S, H, E, C, P, OE, OM and VE.

It is further to be noted that within this document S is defined such that a smaller magnitudes mean less occlusion. However, S could be just as well defined such that larger magnitudes mean less occlusion. S according to the alternative definition is the multiplicative inverse of S according the primary definition. In case of such an alternative definition statements regarding S and formulas comprising S would have to be adapted accordingly. In particular the formula S=1/(1+P*C) would have to be changed to S=1+P*C. For magnitudes expressed in decibels the additive inverse would have to be used, i.e. "$|S|_{dB}$" would have to be changed to "$-|S|_{dB}$". Claims containing such statements and/or formulas are to be interpreted such that they cover both definitions of S. Their substantial meaning is not changed by an alteration of the definition of S. The same applies in a similar manner for H, E, C, P, OE, OM and VE.

The fitting device may be configured for providing various graphical information about the fitting process and the fitting result, for example Bode plots of complex functions, graphs of spectral functions and bar or pie charts of continuous parameters or ratings. Diagrams may show for example characteristics of P, $C_{RAW}$, C, S, OE, VE, OM, $F0_L$, $F0_{Spectrum}$ and $\{R_1, R_2, R_3 \ldots\}$, in particular in relation to each other and/or for different compensator filter datasets in the same diagram. For example the Bode plot of different S shown in FIG. 4 may be fully or partially displayed to the fitter. The subjective evaluation of dataset candidates $\{C_A, C_B, C_C, \ldots\}$ by the user may be fully or partially replaced by a graphical evaluation by the fitter.

It is estimated that only a small percentage hearing aid users may benefit from an active occlusion control, even if it is optimally fitted. Therefore, in a preferred embodiment of the invention, a benefit assessment is carried out at one or more stages of the method. The subjective benefit can be assessed, as already described above, by comparing one or more configurations having active occlusion control, such as configurations "A", "B" and "C", with a configuration "Ø" not having it. Besides of that or instead of that an automatic benefit assessment may be carried out to determine if a substantial benefit can be provided to the user 31 by the active occlusion control feature. If no substantial benefit can be provided the system outputs a corresponding message. The message can for example be an acoustic and/or visual message presented by the fitting device 12. One potential reason for insufficient benefit may be that the user has a relatively strong low frequency hearing loss such that he or she does not perceive occlusion sounds in the first place. Best candidates for occlusion control are individuals having mild hearing losses. Hence, the benefit assessment may comprise the step of analyzing the user's hearing loss or audiogram, in particular by checking if the hearing loss is less than 40 dB at a set of frequencies relevant for occlusion, in particular at 125 Hz, 250 Hz and/or 500 Hz. Further measures may be properties of the complex frequency-dependent plant transfer function P, of the objective frequency-dependent occlusion effect function OE or |OE|, of the frequency-dependent vent effect function VE or |VE| and/or of the fundamental frequency F0 or fundamental frequency range $\{F0_{min}, F0_{max}\}$ of the user. The feature is useless if there is no substantial or no occlusion effect in the first place, for example if the vent 10 is sufficiently large and if there is no need to reduce its size. Once a compensator filter dataset C has been determined, it is possible to calculate and assess values indicative of the strength of the obtainable occlusion modification, in particular $S_{min}$, $OM_{min}$, $A_2$, $S_{int}$ and/or $\Delta f$ as well as $f_{min}$, $f_{max}$ and/or $f_{S=Smin}$ in relation to F0, $F0_{min}$ and/or $F0_{max}$. The assessments are preferably carried out as soon as the necessary data becomes available, in particular directly after a corresponding acoustic measurement. Hearing loss data may be available before inserting the hearing aid for the first time, and in particular before selecting a hearing aid.

Although the inventions disclosed herein have been described in terms of the preferred embodiments above, numerous modifications and/or additions to the above-described preferred embodiments would be readily apparent to one skilled in the art. It is intended that the scope of the present inventions extend to all such modifications and/or additions and that the scope of the present inventions is limited solely by the claims set forth below.

We claim:

1. A method comprising the steps of:

inserting a part of a hearing device (3) into the ear canal (2) of a user (31), the hearing device (3) including an outside microphone (4), a receiver (7) for emitting sound into the ear canal (2), a canal microphone (8), and an occlusion control compensator filter (9) arranged in a feedback loop and configurable by a compensator filter dataset (C), and having a fitting mode and an operation mode;

establishing a communication connection (26, 27, 28) between the hearing device (3) and a fitting device (12);

switching the hearing device (3) into the fitting mode;

obtaining a complex frequency-dependent plant transfer function (P) that represents the relation between an input to the receiver (7) to an output from the canal microphone (8) by sending a plant stimulus signal to the receiver (7) while a part of the hearing device (3) is in the ear canal (2) of the user (31) and analyzing a resulting sound that is sensed in the ear canal (2) by the canal microphone (8);

producing a reference sound with the user's (31) voice while the hearing aid receiver (7) is switched off;

obtaining an objective frequency-dependent occlusion effect function (OE, 10E1) and/or the at least one property of it, while the user's (31) voice is producing the reference sound, the receiver (7) is switched off and a part of the hearing device (3) is in the ear canal (2) of the user (31), by analyzing a canal sound in the ear canal (2) that is sensed by the canal microphone (8) in conjunction with the reference sound that is sensed by the outside microphone (4);

using the complex frequency-dependent plant transfer function (P) and the objective frequency-dependent occlusion effect function (OE, 10E1) and/or the at least one property of it, to determine the compensator filter dataset (C); and configuring the occlusion control compensator filter (9) with the compensator filter dataset (C) with the fitting device (12).

2. The method of claim 1, wherein the compensator filter dataset (C) is determined by selecting a raw compensator filter dataset (CRAW, C1, C2, C3, . . . , CA, CB, CC, . . . ) from a plurality of stored raw compensator filter dataset candidates ({C1, C2, C3 . . . }) for further processing or for direct use as the compensator filter dataset (C).

3. The method of claim 2, wherein the further processing comprises scaling the raw compensator filter dataset (CRAW, C1, C2, C3, . . . , CA, CB, CC, . . . ) with a scaling factor (g, g1, g2, g3 . . . , gA, gB, gC . . . ) to obtain the compensator filter dataset (C) or a candidate compensator filter dataset (CA*gB, CA*gB, CA*gB, . . . ).

4. The method of claim 2, wherein the compensator filter dataset (C) is determined by applying a selection criterion (K)

or a set of selection criteria ({K1, K2, . . . }) to each candidate of the set of raw compensator dataset candidates ({C1, C2, C3 . . . }) to identify a raw compensator dataset candidate (CRAW) and/or a set of raw compensator dataset candidates ({CA, CB, CC, . . . }).

5. The method of claim 4, wherein the selection criterion (K) is applied by temporarily configuring the hearing aid device (3) based on a first candidate of the set of raw compensator dataset candidates ({CA, CB, CC, . . . });

temporarily configuring the hearing aid device (3) based on a second candidate of the set of raw compensator dataset candidates ({CA, CB, CC, . . . });

obtaining an absolute or relative evaluation information in regard to one or more candidates from the user (31); and determining a configuration based on the evaluation information from raw compensator dataset candidate (CRAW) that was selected from the set of raw compensator dataset candidates ({CA, CB, CC, . . . }).

6. The method of claim 1, further comprising the step of:

using a frequency-dependent vent effect and/or leakage function (VE, |VE|) of an earpiece of the hearing aid device (3) or a cutoff frequency (fVE) of a high-pass filter approximation of such a function to determine the compensator filter dataset (C);

wherein the a frequency-dependent vent effect and/or leakage function (VE, |VE|) of an earpiece of the hearing aid device (3) or a cutoff frequency (fVE) of a high-pass filter approximation of such a function is one or more of (a) entered and stored, (b) measured and (c) derived from the complex frequency-dependent plant transfer function (P) by analyzing a low frequency roll-off of the complex frequency-dependent plant transfer function (P) and/or by applying a low-frequency fitting method of a filter in regard to the complex frequency-dependent plant transfer function (P).

7. The method of one of claim 1, further comprising the step of using a fundamental frequency (F0) and/or a fundamental frequency range ({F0min, F0max}) of the user's (31) voice to determine the compensator filter dataset (C);

wherein the fundamental frequency (F0) and/or fundamental frequency range ({F0min, F0max}) of the user's (31) voice is one of (a) entered, (b) estimated based on data relating to the user's (31) gender and/or age, and (c) measured by the outside microphone (4) and/or the canal microphone (8) while the hearing aid device (3) is muted and the user's voice (31) voice is active.

8. The method of claim 7, wherein the fundamental frequency (F0) and/or fundamental frequency range ({F0min, F0max}) of the user's (31) voice is measured together with the objective frequency-dependent occlusion effect function (OE, |OE|) and/or the at least one property of it by acquiring sound data with the outside microphone (4) and the canal microphone (8) while the hearing aid device (3) is muted and by using the sound data for both measurements.

9. The method of claim 1, further comprising the step of:

performing an automatic benefit assessment that determines whether or not a benefit can be provided to the user (31) by the canal microphone (8) and the occlusion control compensator filter (9) and, if the benefit cannot be provided, outputting a corresponding acoustic and/or visual message;

wherein the automatic benefit assessment involves one or more of the following:

(a) analyzing the user's hearing loss and/or audiogram to determine whether hearing loss is less than 40 dB at a set of frequencies that includes 125 Hz, 250 Hz and/or 500 Hz;

(b) analyzing the complex frequency-dependent plant transfer function (P);

(c) analyzing the objective frequency-dependent occlusion effect function (OE, |OE|) and/or the at least one property of it;

(d) analyzing a frequency-dependent vent effect and/or leakage function (VE, |VE|) or a cutoff frequency (fVE) of a high-pass filter approximation of such a function;

(e) analyzing a fundamental frequency (F0) or a fundamental frequency range ({F0 min, F0max});

(f) analyzing an occlusion modification achievable with the canal microphone (8) and the occlusion control compensator filter (9);

(g) performing an automatic benefit assessment more than one;

(h) performing an automatic benefit assessment prior to inserting the hearing aid device (3) into the ear canal (2) or prior to obtaining the complex frequency-dependent plant transfer function (P);

(i) performing an automatic benefit assessment each time new relevant data becomes available; and (j) performing an automatic benefit assessment after one, more than one, or all acoustic measurements of the fitting method.

10. The method of claim 1, wherein the plant stimulus comprises a recorded real life sound, a combination of a recorded real life sound with an artificial sound, and/or a processed or unprocessed environment sound.

11. The method of claim 1, wherein the step of obtaining an objective frequency-dependent occlusion effect function (OE, |OE|) and/or at least one property of it includes one or more of the following steps:

(a) temporarily closing a vent (10) of the hearing aid device (3) while measuring the objective frequency-dependent occlusion effect function (OE, |OE|) and/or the at least one property of it;

(b) temporarily muting the hearing aid device (3) while measuring the objective frequency-dependent occlusion effect function (OE, |OE|) and/or the at least one property of it;

(c) instructing the user (31) to speak freely, read a text, repeat a word or a sentence, ask a question, sweep a vowel and/or speak different vowels and/or consonants;

(d) vibrating the user's body;

(e) applying an open ear gain compensation to the canal sound or to the reference sound;

(f) calculating a difference of a logarithmic frequency domain representation of the canal sound;

(g) calculating a quotient of a frequency domain representation of the canal sound.

12. The method of claim 1, wherein the compensator filter dataset (C) is comprises one or more of the following:

(a) a set of scalar filter coefficients of a numerator polynomial in z and coefficients of a denominator polynomial in z;

(b) data defining a filter of nth order;

(c) data defining a complex frequency-dependent filter function;

(d) a complex vector having a predefined dimension;

(e) data defining a filter having a frequency resolution of a third octave;

(f) data defining a frequency-discrete or a frequency-continuous filter;

(g) data defining a time-discrete or a time-continuous filter;
(h) data being compressed and/or reduced to a data size of less than 100 bytes;
(i) a result of combining a raw filter (CRAW) with a scaling factor;
(j) data stored in and/or derived from data stored in a database (22);
(k) data used in a processor of the fitting device (12);
(l) data stored in a non-volatile memory of the hearing aid device (3);
(m) data used in a signal processor of the hearing aid device (3).

13. The method of claim 1, wherein the hearing aid device (3) is one or more of the following:
(a) a hearing aid configured to compensate for a hearing loss of the user (31);
(b) a hearing protection device configured for hearing in noisy environments;
(c) an ITE or in-the-ear hearing aid device;
(d) a modular hearing aid device having an in-the-ear module that includes both the receiver (7) and the canal microphone (8) and a behind-the-ear module, the behind-the-ear module and the in-the-ear module being electrically connected to each other;
(e) a hearing aid device configured for self-fitting by the user (31);
(f) a hearing aid device with an earpiece that includes a vent (10) with a diameter in a range from 0.6 mm to 1.2 mm.

14. The method of claim 1 wherein the fitting device (12) comprises one or more of the following:
(a) a device or system equipped with memory, a processor, and fitting software stored in the memory and executable by the processor;
(b) a personal computer, laptop computer, tablet computer, notebook, sub-notebook or workstation;
(c) a smartphone;
(d) a hearing aid device remote control;
(e) an assisted living device;
(f) a unit integrated in the hearing aid device (3);
(g) a device or system configured for remote fitting;
(h) a device configured for self-fitting.

* * * * *